United States Patent [19]

Flugger

[11] Patent Number: 4,550,799

[45] Date of Patent: Nov. 5, 1985

[54] MUFFLER FOR EXHAUST GASES

[75] Inventor: Ray T. Flugger, Santa Rosa, Calif.

[73] Assignee: Wayne King, Modesto, Calif.

[21] Appl. No.: 468,866

[22] Filed: Feb. 22, 1983

[51] Int. Cl.[4] ..... F01N 1/24

[52] U.S. Cl. ..... 181/244; 181/258; 181/265; 181/268; 181/281

[58] Field of Search ..... 181/252, 256, 264, 265, 181/258, 268, 281, 244

[56] References Cited

U.S. PATENT DOCUMENTS

| | | | |
|---|---|---|---|
| 792,804 | 6/1905 | Williams | 181/265 |
| 2,640,557 | 6/1953 | Gaffney | 181/265 X |
| 3,710,891 | 1/1973 | Flugger | 181/256 |

*Primary Examiner*—Benjamin R. Fuller

*Attorney, Agent, or Firm*—Manfred M. Warren; Robert B. Chickering; Glen R. Grunewald

[57] ABSTRACT

A muffler for dissipating the sound component in exhaust gases from an internal combustion engine or the like is disclosed which has an enhanced useful life. The muffler includes a partition positioned across an incoming stream of exhaust gases. The partition is formed with stream dividing or splitting means which positively divides the stream into portions that can be more evenly directed throughout the muffler. This prevents destructive preferential flow of gases within the muffler. Additionally, shielding of sound absorption material in the muffler is accomplished by selecting the pattern of perforations to reduce the contact of such material with high velocity gases.

4 Claims, 2 Drawing Figures

MUFFLER FOR EXHAUST GASES

BACKGROUND OF THE INVENTION

The present invention relates to mufflers for exhaust gases or the like which have a sound component, such as are typically produced by an internal combustion engine. More particularly, the present invention relates to internal combustion engine mufflers which include a sound absorbing or sound-energy dissipating material such as fiber glass.

I have previously discovered that a muffler can be constructed in which the sound or noise component in an exhaust stream is dissipated, in part, by causing reflection of the sound component through deflected and swirling streams of gas passing through the muffler. Thus, in addition to the sound dissipating effect of the sound absorbing material in the muffler, the combustion gases also act to deaden various sound frequencies found in the gases and to cooperate in the overall noise reduction achieved in the muffler. Such a muffler construction is shown in my prior U.S. Pat. No. 3,710,891.

While the muffler of U.S. Pat. No. 3,710,891 is highly effective in dissipating sound energy in exhaust gases without undesirably increasing the back pressure in the exhaust stream, certain manufacturing problems have been encountered which affect muffler life. One of the key aspects of the muffler of U.S. Pat. No. 3,710,891 is the provision of a flat plate partition or abutment or a cup-shaped partition which extends laterally across the incoming stream of gases and deflects gases and their sound component laterally and rearwardly toward sound absorbing material in the muffler. Such partitions or abutments are conventionally mounted in a perforated tube or channel-defining means into which exhaust gases are discharged in a stream, usually through a Venturi nozzel.

If the angular relationship between the stream of exhaust gases and the plate or cup-type partition is exactly perpendicular, the exhaust gases will be evenly deflected laterally over 360° about the longitudinal axis of the stream of gases. As a practical matter, however, the partition or abutment is seldom exactly perpendicularly aligned with respect to the stream of incoming gases. An angular misalignment of even one or two degrees will produce highly preferential flow, that is, deflection of the gases toward one side of the muffler. Such preferential flow resulting from partition or abutment misalignment in turn causes an undesirably high volume of high temperature and velocity of gases to impringe upon the sound absording material positioned proximate the periphery of the muffler casing. It has been found, therefore, that such preferential flow will cause premature breaking down and degradation of the sound absorbing material, with the result that the muffler has a useful life which is shortened by this erosion. In extreme cases, preferential flow will also cause such elevated temperatures in the sound absorbing material and casing as to produce buckling and or burnout of the internal structure of the muffler and/or the casing wall.

OBJECT OF THE INVENTION

Accordingly, it is an object of the present invention to provide a muffler for internal combustion engines or the like which is highly effective in dissipating sound energy without producing back pressure and has an improved useful life.

It is a further object of the present invention to provide a muffler of the type employing a sound absorbing material or media in which erosion and degradation of the media by the exhaust gases is minimized.

It is a further object of the present invention to provide a muffler for an internal combusion engine or the like which has an enhanced life and yet is easy to manufacture and assemble.

The muffler of the present invention has other objects and features of advantage which will become more apparent from the following description of the preferred embodiment and the accompanying drawing.

SUMMARY OF THE INVENTION

A muffler for exhaust gases having a sound component is provided which includes a casing having a fluid inlet opening and a fluid outlet opening, a sound absorbing material positioned inside the casing, means formed to direct the exhaust gases in a stream proximate the sound absorbing material, and partition means positioned inside the casing and formed to extend transversely across the stream to deflect the stream and sound components toward the sound absorbing material. The improvement in the muffler of the present invention comprises, briefly, the partition being formed to include steam dividing means which positively divides the stream and deflects portions thereof toward an increased area of the sound absorbing material to substantially prevent erosion of the sound absorbing material from any misalignment of the angular orientation of the partition with respect to the direction of flow of the stream. Additionally, the muffler preferably includes a perforated channel-defining tube in which the partition is mounted, and the area of the perforations in the tube decreases proximate the partition so that the flow of exhaust gases laterally after deflection by the partition is restricted. Additionally, the sound absorbing material is preferably retained by a perforated tube mounted concentrically proximate the periphery of the casing, and the perforations in the area of retaining tube proximate the partition are also preferably eliminated to reduce erosion of the sound absorbing material.

DESCRIPTION OF THE PREFERRED EMBODIMENT

Figure 1:
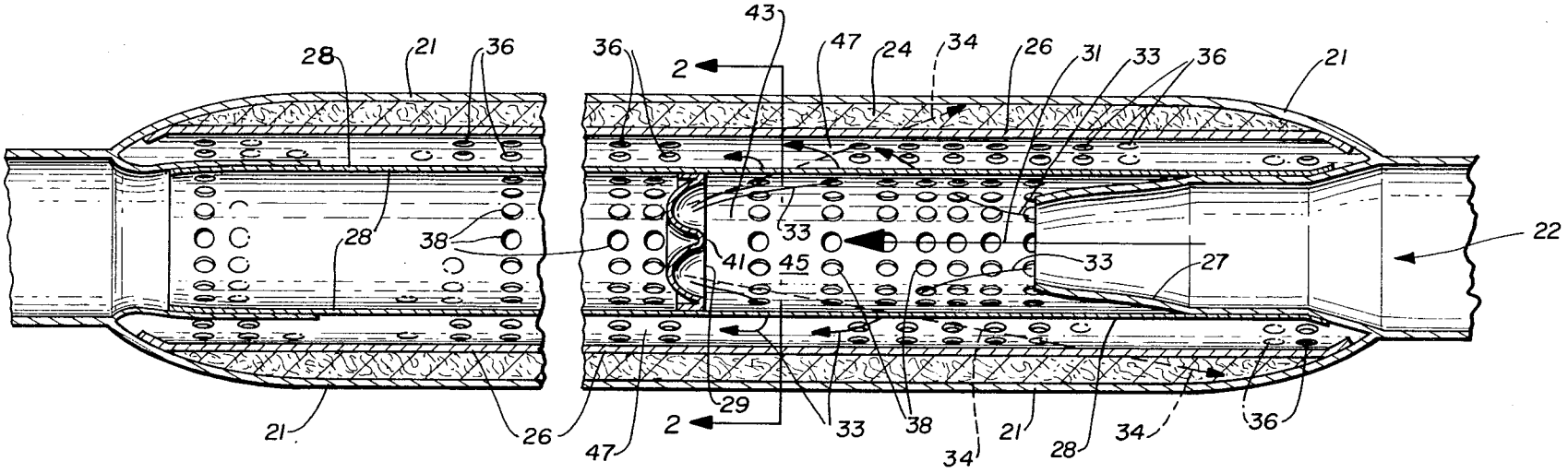
FIG. 1 is a side-elevational view, in cross-section of the muffler constructed in accordance with the present invention.
Figure 2:
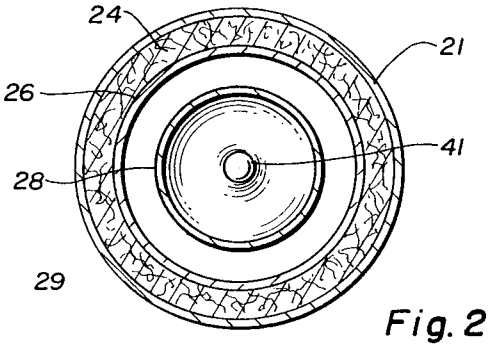
FIG. 2 is a cross-sectional view taken substantially along the plane of line 2—2 in FIG. 1.

As is the case in connection with the muffler set forth in U.S. Pat. No. 3,710,891, the improved muffler of the present invention includes casing 21 having a fluid inlet opening 22 and an outlet or exhaust opening 23 preferably in opposite ends of the casing. Mounted about the interior periphery of the casing is a sound absorbing material 24, which is preferably retained or held in place by tubular perforated retainer member 26. The muffler includes means formed to direct exhaust gases in a stream inside the casing proximate sound absorbing material 24. As shown in the drawing, such means is comprised of a Venturi nozzle element 27 and tubular member 28, which also forms channel defining means for directing the stream of exhaust gases into the interior of the muffler against a partition or abutment 29.

The exhaust gases discharged from Venturi 27 flow in a stream, as indicated by arrow 31, toward partition 29. The partition extends transversely across the stream, preferably at right angles thereto, to deflect the stream and any sound components therein laterally and rearwardly toward sound absorbing material 24. As shown in the drawing, the gaseous portion of the stream is indicated by solid arrows 33, while the sound component is indicated by dashed or broken arrows 34. As will be seen, partition means 29 causes lateral deflection of both sound and gas toward casing 21 and sound-damping material 24. Since the sound-damping material is typically a porous packing, such as fiber glass, which fills the space between retainer member 26 and casing 21, the bulk of the gas tends to flow around partition 29 in the annular space between channel defining tube 28 and retainer member 26. Some gas will, of course, enter into the sound absorbing material through apertures 36 in retainer member 26. As will be apparent, the sound component of exhaust gases tends to be reflected by partition 29 in a manner which crosses the bulk of the flow of the exhaust gases down the annular space between tension member 26 and tubular member 28. This cross flow of sound and gases assists in the damping sound energy absorption process in the muffler.

The exhaust gases flow down to the downstream side of partition 29 and then enter through perforations 38 in tubular member 28, where they are free to pass out through outlet opening 23 of the muffler. The sound components will be reflected off of the casing wall 21 and pass back through the sound absorbing material until they are again reflected by retainer member 26 or tubular inlet member 28. The sound component will then be reflected again and passed through the exhaust gas and/or the absorption material several times before exiting the muffler through outlet opening 23. This reflection and passage of the sound component through the various densities of the muffler gas and sound energy-absorbing material 24 results in attenuation and dissipation of the sound energy so that the component exiting from the muffler is acceptable in the intensity and frequency of sound emitted.

The use of a simple perforated tube having a transverse partition and a sound absorbing material retained next to the inside periphery of the casing effects sound dampening without undesirably increasing the back pressure in the muffler.

As thus far described, the muffler of the present invention has components which are found in U.S. Pat. No. 3,710,891. In the improved muffler of the present invention, however, partition means 29 is formed to positively divide or split the stream of exhaust gases so that portions of the stream are deflected toward an increased area of the sound absorbing material to substantially prevent erosion of this material which can result from misalignment of the partition. The stream-dividing or stream splitting means of the muffler of the present invention is preferably provided by a protrusion 41 which extends outwardly from the upstream side of partition 29 at a location approximately at the center of impact of the partition by the stream of gases. Instead of providing the partition as a flat or slightly convexed surface, partition 29 in the muffler of the present invention is a cupped-shaped member having a generally conical protrusion 41 formed in the center thereof. This construction will positively divide the exhaust gases even if the cup is somewhat tilted with respect to tubular member 28 in which it is mounted.

It has been found that it is extremely difficult to precisely position a partition or abutment inside tube 28 in exactly an orientation which will be perpendicular to the stream impinging upon the partition. If the partition is angularly misaligned or if nozzle 27 is somewhat misaligned, a flat or convex partition will produce preferential flow of the exhaust gases toward one side or the other of the muffler. This preferential flow produces heat concentrations and erosion and degradation of the sound absorbing material 24 and retainer 26, and sometimes even casing 21. The stream dividing means 41 of cup 29, however, will cause a division of the incoming exhaust gas stream, even if the stream is somewhat skewed or the partition is somewhat skewed in its angular orientation. Under such angularly misaligned conditions, the stream divider will not cause flow to be absolutely evenly distributed about the muffler, but it will eliminate the tendency of flat plat partitions to concentrate virtually all of the gases for flow against one side of the muffler. Thus, even without any further modification of my prior muffler, the provision of a partition or abutment which includes stream splitting or dividing means will ensure a more even flow in the muffler so as to reduce the problem of erosion and excessive heat build up in sound-aborbing media 24.

The muffler of the present invention further advantageously includes shielding features which will reduce muffler erosion and increase the muffler's useful life. Channel defining tubular member 28 is formed with perforations 38 through which both exhaust gases and sound components escape, particularly after impact with partition 29. In order to further reduce possible erosion of sound absorbing material 24, it is preferable that the area of the perforations per unit length of tube 28 be less or reduced proximate partition 29, as compared to the area of perforations remote of the partition member, for example at discharge nozzle 27. As will be seen from FIG. 1, there are essentially no perforations in the area 43 immediately adjacent to and upstream of partition 29. Similarly, a substantial area 45 exists between the first two rows of perforations 38. The frequency of the rows of perforations 38 increases toward nozzle 27 until a relatively uniform spacing is achieved.

This reduction in the number of perforations in the inlet defining tube 28 proximate partition 29 restricts the rate at which gases can flow laterally out toward the sound absorbing material in the muffler. This restriction tends to cause some of the flow on the periphery of the stream discharged from nozzle 27 to exit out through perforations 38 prior to impacting partition 29, which effects further swirling and mixing action which is believed to be of assistance in dampening the sound. The elimination of perforations immediately proximate the partition, in any event, does make the path traveled to the sound absorbing material by the exhaust gases more tortuous so as to slow the gases and shield the sound absorbing material from erosion.

In order to further reduce the likelihood of erosion, it is another feature of the present invention that tubular retainer member 26 is formed with an inperforate area or section 47 proximate and on the upstream side of partition means 29. The retaining member is perforated at openings 36 on the upstream side of the partition beyond section 47 and is also preferably perforated on the downstream side of the partition. Again, the elimination of perforations from area 47 reduces the exposure of the sound absorbing material to rapidly moving hot exhaust gases in the area in which erosion is most likely to occur.

The combination of providing a partition having stream splitting or dividing means positioned proximate the area of impact by the exhaust stream and shielding the sound absorbing media 24 from direct contact with high speed gases in the area of greatest gas flow results in a muffler having a greatly improved useful life. Moreover, the effect of splitting the exhaust stream positively by a protrusion or similar structure is that the precise alignment of the partition in the muffler with respect to the stream of exhaust gases entering the muffler is not as critical or sensitive to muffler life. The muffler can, therefore, be constructed using conventional muffler forming techniques without extreme care being required in the exact angular alignment of the partition 29 and/or nozzle 27.

It has been found that by use of a partition having means for positively dividing the stream of gases as above set forth, a substantial and important increase in the volume of gases passing through the muffler can be achieved. Thus, the annular flow channel defined between perforated tubular members 26 and 28 can be increased significantly to effect greater flow through the muffler (and thus less back-pressure) for a given level of sound attenuation as compared to the muffler of my U.S. Pat. No. 3,710,891. This phenomenon in part may result from attenuation of sound at the initial impact with a partition having an up-stream protruding stream splitting dome 41. The stream splitting means 41 deflects the noise component of the incoming stream at various angles, as compared to a flat plate partition or the bottom of a cup-shaped partition, each of which tend to deflect the sound component back along parallel lines toward the incoming stream and the engine.

Whatever the mechanism, the stream splitting partition of the present invention is more efficient in damping noise and allows a reduction in engine back-pressure for a given noise level. This is also significant in reducing the overall muffler weight because the same noise attenuation can be achieved by a shorter muffler.

What is claimed is:

1. A muffler for exhaust gases or the like having a sound component therein, said muffler including a casing having a fluid inlet opening and a fluid outlet opening, stream forming means positioned proximate said inlet opening and formed to direct exhaust gases in a stream inside said casing from said inlet opening toward said outlet opening, sound absorbing material positioned to extend longitudinally inside said casing laterally of said stream, and partition means positioned inside said casing and formed to extend transversely across said stream and to terminate in a periphery of said partition means spaced apart from said casing to deflect said stream formed by said stream forming means and sound components therein laterally in said casing around said periphery of said partition means for flow toward said sound absorbing material and said outlet opening, wherein the improvement in said muffler comprises:

said partition means being provided with stream splitting means formed to positively divide said stream into a plurality of stream portions for flow around said periphery of said partition means, said stream splitting means being positioned in said casing proximate the center of the area of impact of said stream with said partition means to laterally deflect stream portions of substantially equal volume toward said sound absorbing material to prevent perferential erosion of said sound absorbing material, and said stream formed means and said stream splitting means being further formed to cooperatively define a plurality of flow paths for exhaust gases which extend through said casing from said inlet opening around said periphery of said partition means to said outlet opening without reversal of the direction of flow of said gases for low backpressure flow of said gases through said muffler.

2. A muffler for exhaust gases or the like having a sound component therein, said muffler including a casing having a fluid inlet opening and a fluid outlet opening, stream forming means positioned proximate said inlet opening and formed to direct exhaust gases in a stream inside said casing from said inlet opening toward said outlet opening, sound absorbing material positioned to extend longitudinally inside said casing laterally of said stream, and partition means positioned inside said casing and formed to extend transversely across said stream to deflect said stream and sound components therein laterally in said casing toward said sound absorbing material, wherein the improvement in said muffler comprises:

said partition means being provided with stream splitting means formed to positively divide said stream into a plurality of stream portions for flow around said partition means, said stream splitting means being positioned in said casing proximate the center of the area of impact of said stream with said partition means to laterally deflect stream portions of substantially equal volume toward said sound absorbing material to prevent perferential erosion of said sound absorbing material;

said stream forming means including perforated tubular channel defining means positioned in said casing and formed to receive said gases from said inlet opening;

said partition means being mounted substantially perpendicularly across said channel defining means for deflection of said stream laterally out through perforations in said channel defining means;

said channel defining means is formed with fewer perforations per unit length proximate said partition than the number of perforations per unit length proximate said inlet opening;

perforated retainer means positioned concentrically and in spaced relation to said channel defining means;

said sound absorbing material being positioned between said casing and said retainer means; and said retainer means being imperforate proximate and on upstream side of said partition means and perforate remote of said partition means on said upstream side.

3. A muffler as defined in claim 1 wherein, said stream splitting means is formed as a protrusion outwardly of said partition means at a location positioned approximately at the center of impact of said partition means by said stream.

4. A muffler as defined in claim 3 wherein, said partition means is a cup-shaped member and said protrusion is conical and positioned at about the center of said member.

* * * * *